US005392862A

United States Patent [19]

Swearingen

[11] Patent Number: 5,392,862

[45] Date of Patent: Feb. 28, 1995

[54] FLOW CONTROL SUB FOR HYDRAULIC EXPANDING DOWNHOLE TOOLS

[75] Inventor: Bruce D. Swearingen, The Woodlands, Tex.

[73] Assignee: Smith International, Inc., Houston, Tex.

[21] Appl. No.: 203,133

[22] Filed: Feb. 28, 1994

[51] Int. Cl.[6] ..... E21B 33/12

[52] U.S. Cl. ..... 166/386; 166/239; 166/318

[58] Field of Search ..... 166/239, 318, 381, 386; 175/24–26, 38, 94, 99, 100, 218, 268

[56] References Cited

U.S. PATENT DOCUMENTS

| | | | |
|---|---|---|---|
| 3,995,692 | 12/1976 | Seitz | 166/318 |
| 4,031,957 | 6/1977 | Sanford | 166/318 X |
| 4,252,196 | 2/1981 | Silberman et al. | 166/318 |
| 4,294,314 | 10/1981 | Miyagishima et al. | 166/318 |
| 4,427,070 | 1/1984 | O'Brien | 166/318 X |
| 4,520,870 | 6/1985 | Pringle | 166/332 X |
| 4,566,541 | 1/1986 | Moussy et al. | 166/318 |
| 4,574,894 | 3/1986 | Jadwin | 166/318 X |
| 4,967,841 | 11/1990 | Murray | 166/318 X |
| 5,181,569 | 1/1993 | McCoy et al. | 166/318 X |
| 5,318,118 | 6/1994 | Duell | 166/318 X |

*Primary Examiner*—Roger J. Schoeppel
*Attorney, Agent, or Firm*—Robert G. Upton

[57] ABSTRACT

A hydraulic control sub assembly for actuating hydraulically operated downhole remedial tools, such as section mills or underreamers, is disclosed. The control sub features a drop ball mechanism to terminate the flow of drilling fluid to the hydraulic tool thereby inactivating the tool. The control sub also has a hydraulic rupture disc that permits drilling fluid circulation when tripping the drill pipe. The control sub further contains upwardly directed jet nozzles to enhance fluid flow in the well bore to help clear away debris. A float valve is also incorporated in the control sub to ensure there is no fluid under high pressure trapped in the hydraulic tool that may jam the tool.

9 Claims, 2 Drawing Sheets

FLOW CONTROL SUB FOR HYDRAULIC EXPANDING DOWNHOLE TOOLS

I. FIELD OF THE INVENTION

The present invention relates to hydraulically activated downhole remedial tools.

More specifically, this invention relates to a drilling mud flow control sub that provides the necessary fluid flow and pressure to activate an expanding remedial tool such as an underreamer, section mill or other cutting tools. The flow control sub has the means to terminate the fluid flow to the tools hydraulic actuating mechanism to close the cutting arms. A means is also provided by the sub to allow fluid circulation through the sub with the cutting mechanism deactivated while "tripping" and/or rotating the drill string.

II. BACKGROUND

It is well known in the art of downhole remedial cutting tools to utilize the principle of pumping drilling fluid through a nozzle or restriction near the lower end of the drill string to drop the pressure in the well bore annulus around the tool body by a calculated amount. This creates a pressure differential between the high pressure inside the tool and the now lower pressure in the well bore annulus. This pressure differential is used to drive a piston, for example, to extend hinged cutter arms. When the cutter arms are forced by the piston into the extended cutting position, the drill string is rotated and the cutters mill up steel casing, rock formation or other downhole equipment. The cuttings from the milling operation ofttimes are very difficult to remove from the well bore to the surface. This is especially true in high angle holes. The steel cuttings and other debris tend to pack-off on the lower side of the essentially horizontal hole. It is, therefore, imperative that high fluid volumes and velocities be used to efficiently clear the hole of cuttings as the milling tool is prone to getting stuck in the borehole. This is especially true if the fluid flow is stopped or greatly reduced.

Pumping high volumes of drilling fluid while "tripping" the drill string out of the hole or while rotating and moving the drill pipe up and down inside casing with the tool arms closed is generally desirable but is not possible with equipment now available.

The hydraulically activated cutter arms tend to jam if the acuator nozzle plugs and the float valve traps pressure between the float valve and the nozzle.

Although present day equipment for remedial borehole work do a very credible job, there are circumstances that cause acute problems such as stuck drill string with associated "fishing" jobs, lost equipment in the hole and damaged casing to list a few. All of the above problems are very costly, dangerous and time consuming, especially in the offshore domains such as the North Sea, the Arctic and other areas where the operating costs can be up to $60,000 per day.

This invention minimizes the aforementioned risks usually associated with the use of present day hydraulically expandable remedial oil field tools.

SUMMARY OF THE INVENTION

A flow control sub assembly for hydraulically activated tools utilized in downhole operations performed in well boreholes is disclosed. The flow control sub assembly consists of a cylindrical sub assembly housing forming a first upstream end and a second downstream end. The housing is threadably connected between a drill string at its first upstream end and a tool at its downstream end. The housing forming a means within the housing, intermediate the first and second ends, to stop hydraulic fluid flow to the tool to inactivate the tool and to divert the fluid within the housing to an annulus formed between the housing and a wall of the borehole. The diverted flow provides a high volume of fluid around the inactivated tool to continually remove detritus from the downhole operations and to help prevent the tool and the flow control sub assembly from becoming stuck in the borehole as the drill string is removed from the borehole.

It is an object of this invention to provide a sub for use with a downhole hydraulically expandable cutting tool that has the capability of furnishing adequate drilling fluid circulation while operating the tool and also when tripping the drill pipe with the tool deactivated.

It is also an object of this invention to provide a means to affect upwardly directed drilling fluid flow with the tool activated to enhance drilled cuttings removal up the borehole.

It is yet another object of this invention to provide a one-way valve above the tool to prevent back wash of cuttings and debris into the expandable tool mechanism, thereby preventing jamming.

The foregoing objects and advantages are attained by using a hydraulically activated tool controlled by a fluid control sub threadably attached to the top of the hydraulic tool and to the lower end of the drill string. The expandable cutter arms are activated hydraulically by forcing drilling fluid through a nozzle or restriction in the bore of the tool. This creates a pressure differential between the high interior pressure and the resultant lower pressure outside the tool in the well bore annulus. This pressure differential is used to drive a piston against a cutter actuation mechanism thereby forcing the hinged cutter arms into an extended cutting or milling position. These arms will remain extended until the fluid volume flow is greatly diminished or stopped, or in other words, until a significant pressure differential no longer exists across the fluid restriction. The arms are then returned to a closed position by a compression spring when the piston moves away from the actuating mechanism. This closed state forms a tool outside diameter smaller than the inside diameter of the well bore casing, thus the drill string and tool can then be extracted through the casing to the surface.

Because it is often desirable to continue pumping a high volume of drilling fluid even with the cutting arms retracted, the hydraulic control sub is configured to permit this. The tubular configured control sub assembly housing is through-bored, but forms a tapered drop-ball seat about mid-length of the bore. A rupture or burst disc assembly is affixed in a hole formed in the control sub wall normal to the sub axis. The rupture disc assembly is positioned somewhat above the drop ball seat formed in the control sub bore. When the milling or reaming with the tool is complete, a metal ball is dropped down the bore of the drill string. The ball is pumped or driven downwardly against a ball seat or reduced diameter section in the control sub, thereby shutting off the fluid to the hydraulic mechanism of the milling tool. Other plugging devices may be used without departing from this invention. The hydraulic fluid pressure is then increased high enough to break the rupture disc allowing fluid circulation to resume. The cutting arms of the tool are deactivated because the pressure inside and outside the tool are now equal with no force acting on the hydraulic piston. Fluid circulation can now be maintained through the drill string while the drill string is tripped out of the hole. This helps evacuate the drilled cuttings out of the hole thereby minimizing the chance of sticking the drill string in the hole.

Another advantage incorporated in the present invention is the use of a plurality of jet nozzles or fluid flow diverter means positioned below the drop ball seat through the wall of the control sub, oriented in an upward direction to furnish high velocity fluid flow to help carry the drill cuttings up the hole when the cutting tool is operating. These nozzles also act as metering devices to control the volume of fluid pumped through the hydraulic cutter arms actuating means. This prevents abnormal fluid erosion of the fluid restrictor in the hydraulic system, and allows higher :fluid volume flow up the well bore annulus to clear it of cuttings or other debris.

Still another advantage of this invention is the incorporation of a one way float valve affixed in the control sub bore above the rupture disc assembly. This valve is a flapper type that permits fluid flow downward only. It also will allow the aforesaid drop ball to readily pass through when pumped down the bore of the sub. The primary purpose of the float valve is to assure that drill cuttings and other debris do not back-wash into and foul up the hydraulic actuator mechanism.

Yet another advantage of the present invention is that the hydraulic rupture or burst disc functions as a safety valve to prevent hydraulic tool jamming in the open or actuated position. Jamming of the hydraulic mechanism in the actuated position can occur when the upwardly oriented jet nozzles in the control sub are purposely run closed, or with no orifices, and the fluid restrictor nozzle in the hydraulic tool has been plugged with debris. The float valve will then trap high pressure fluid between the float valve and the hydraulic piston in the tool. This pressure jams the cutter arms in the extended position. Applying additional fluid pressure to the control sub will break the rupture disc and the tool will close, allowing the tool to be withdrawn frown the well bore.

The foregoing and other objects and advantages can be best understood, together with further objects and advantages, from the ensuing description taken together with the appended drawings.

DESCRIPTION OF THE PREFERRED EMBODIMENTS AND BEST MODE FOR CARRYING OUT THE INVENTION

The following specification taken in conjunction with the drawings sets forth the preferred embodiments of the present invention. The embodiments of the invention disclosed herein are the best modes contemplated by the inventor for carrying out his invention in a commercial environment, although it should be understood that several modifications can be accomplished within the scope of the present invention.

It should be noted at the outset of the present description that the novel hydraulic control sub for down-hole expandable cutting tools of the present invention incorporate, in addition to the hereinafter emphasized novel features, certain conventional features as well. Such conventional features, which are well known to those skilled in the art, are described here only to the extent necessary to explain and illuminate the novel features of the hydraulic control sub of the present invention.

Figure 1:
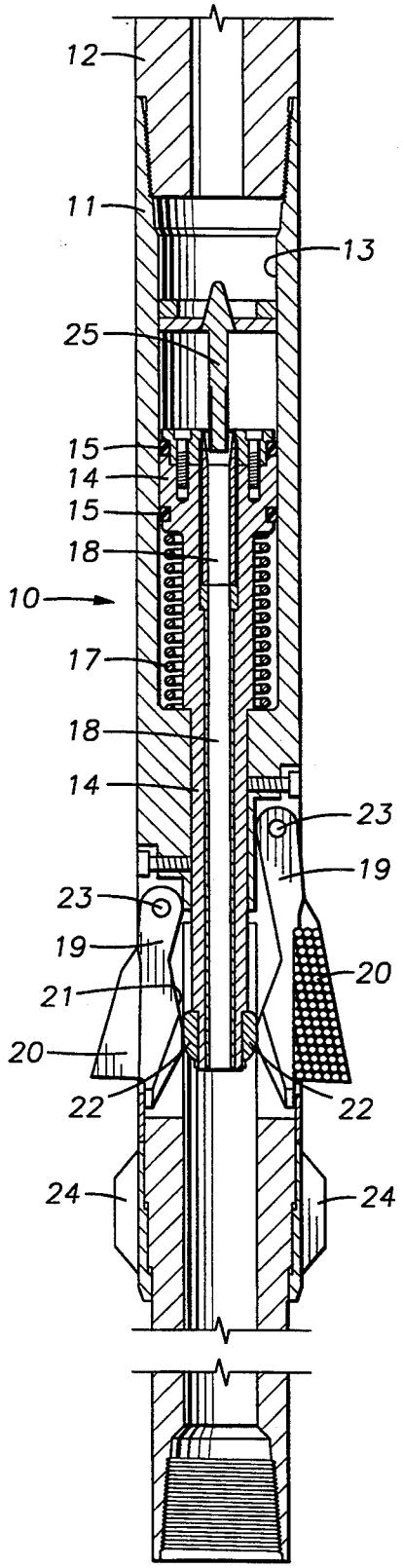
FIG. 1 is a cross-section of a state of the art hydraulically actuated section mill.
Figure 3:
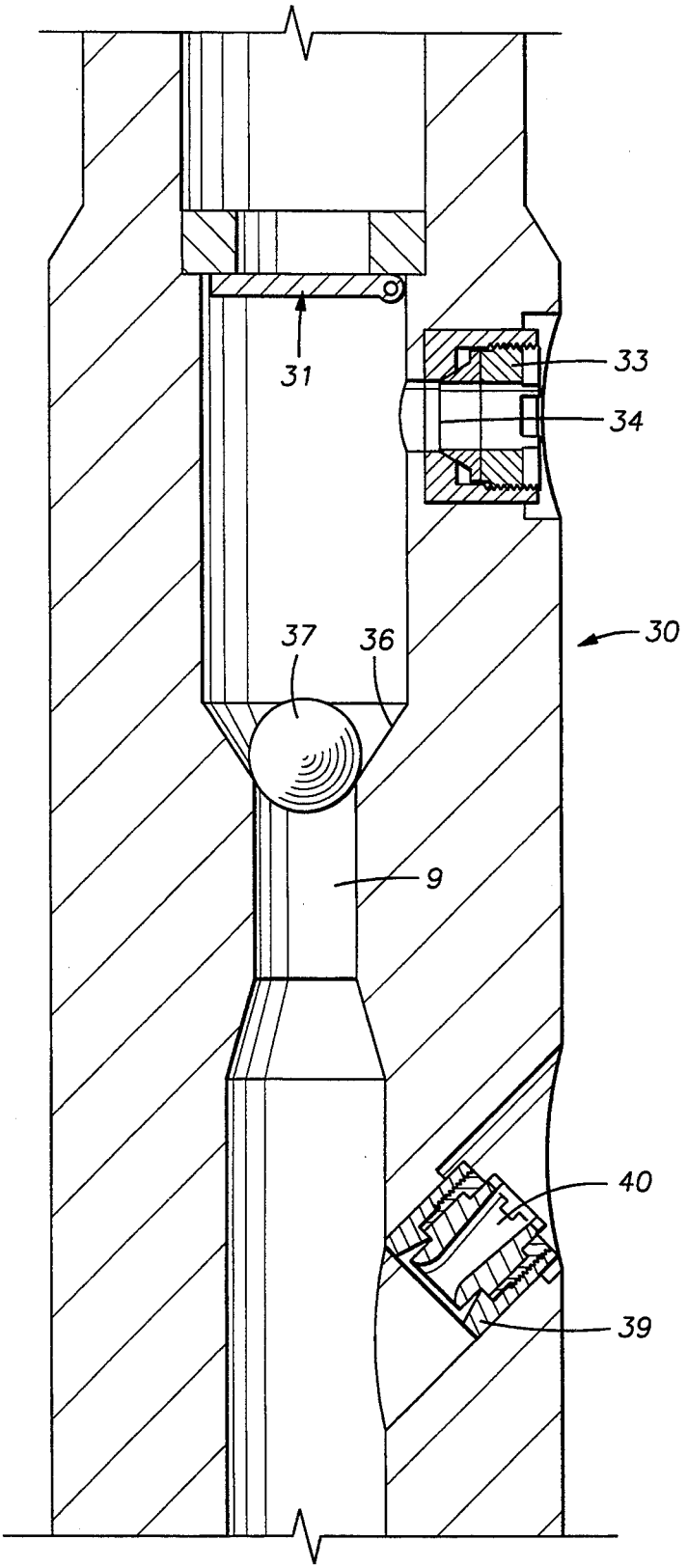
FIG. 3 is a partial cross-section of the control sub assembly of the present invention illustrating the key components thereof.

Referring now to FIG. 1, a prior art hydraulically expandable section mill, generally referred to as 10, is shown actuated in the operating mode. This tool has an essentially tubular body 11 that is threadably attached to a drill string 12. An axially moveable piston 14 is positioned inside the tool body bore 13. The piston 14 is hydraulically biased by the fluid being pumped through the restrictor orifice 18 creating a pressure differential across the piston seals 15. The resultant pressure below the piston 14 is a calculated lower pressure than the pressure above the piston 14. This pressure differential is controlled by the volume of fluid forced through the orifice 18 and must be high enough to overcome the compression spring 16, and the frictional forces of the seals 15 sliding on the tool bore wall 13. It also must be high enough to force the piston tapered cam surface 22 down the cutter arm cam surfaces 21 to extend the cutter arms 19 by pivoting the cutter arms 19 around pivot pins 23. The cutters 20 are thus in position to mill up the steel casing in the well bore hole as the drill string 12 is rotated. The tool stabilizer 24 is run inside the casing to minimize radial movements of the tool assembly 10 while milling. The drilling fluid is pumped down through the restrictor orifice 18 to exit proximate the milling cutters 20 to transport the cuttings up the bore hole annulus. It is very desirable to pump as high a volume as possible to efficiently transport the cuttings but still not erode the restrictor unduly.

Other hydraulically expandable remedial tools, such as underreamers, operate basically the same as the above described section mill. The only basic difference is the configuration of the cutters. The mechanism, shown as 25 positioned within tool 10 is a commercially available pressure indicator device to indicate when the tool 10 is inoperative with the cutters 20 retracted, but does not otherwise have any function contributing to the tool's operation.

Figure 2:
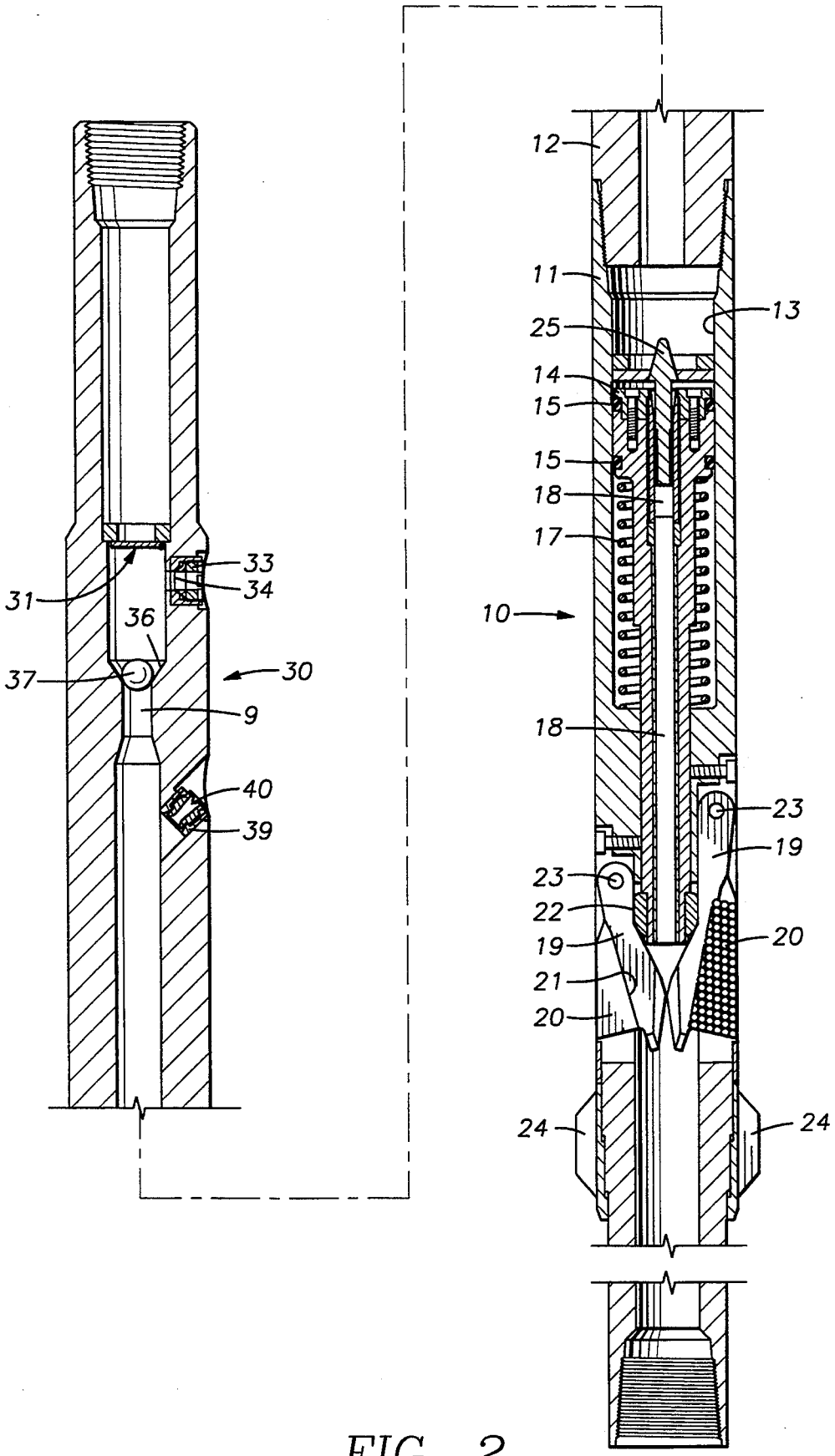
FIG. 2 is a cross-section of the section mill of FIG. 1 illustrated in conjunction with the control sub assembly of the present invention.

Referring now to FIG. 2, the downhole hydraulically expandable section mill 10 has a hydraulic control sub, generally referred to as 30, threadably attached to the top end of the milling tool 10. It should be noted that the cutters 20 are in the inoperative or closed condition unlike the cutters 20 shown in FIG. 1. The cutters 20 can only be inactivated or closed when there is little or no fluid circulation through the tool 10. This may be accomplished by shutting off the mud pumps at the surface, as is the current method, or by using the principles defined in the present invention. The hydraulic control sub 30 of this invention serves as a means to stop the flow of drilling fluid to the milling tool 10. This is accomplished by dropping a metal ball 37 down the drill string bore then, to assure that it seats properly, pumping the ball 37 down until it seats in the truncated conical ball seat 36. When the ball 37 shuts the fluid off to the tool 10, the pressure is automatically balanced across the top and bottom surfaces of the piston 14.

Therefore, the compression spring 17 subsequently drives the piston 14 upwards inactivating or closing the cutters 20. The drill string 12, control sub 30 and milling tool 10 may now be extracted from the well bore without the extended cutters 20 interfering with the well bore or casing.

Normally when a ball 37 is dropped to affect a one-way valve downhole, the mud pumps at the surface must be shut down. If they are not shut down, the pressure increases to the pump limit and activates a safety mechanism that shuts the pumps down. To circumvent this and to allow fluid circulation, while "tripping" the drill string 12 out of the hole, a metal rupture disc 34 is affixed in a retainer 33 in a through hole in the wall of the sub 30 positioned somewhat above the seat for the drop ball 37. The thickness of the rupture disc 34 is chosen to match the hydraulic conditions that exist for a particular well site. The mud pump raises the pressure on the disc 34 until it ruptures, thereby reestablishing fluid circulation in the drill pipe and well bore annulus with the tool cutters 20 in the retracted mode.

It is necessary, at times, to pump higher than normal volumes of drilling fluid up the well bore annulus at high velocity to clear the well bore of drilled cuttings. These large volumes of abrasive muds may have deleterious affects on the restrictor orifice 9 so it may be necessary to divert a part of the fluid volume above the orifice 9 to reduce the velocity through the orifice 9. One or more nozzles 40 are affixed pointing essentially upward in nozzle retainers 39 that are weldably secured in through-holes in the wall of the control sub 30. The upward orientation of the nozzles 40 creates high velocity turbulent flow in the well bore annulus to help transport steel cuttings and other debris up the well bore.

When there is insufficient fluid volume available to operate both the hydraulic tool 10 and the up jet nozzles 40, the nozzles 40 are replaced with plugs (not shown). Detritus removal relies then on the fluid passed through the tool 10 to transport the cuttings up the bore hole.

A commercially available flapper type float valve 31, such as a Baker type G drill pipe float is secured in the bore of the control sub 30 above the rupture disc 34. The purpose of the float valve 31 is to prevent back flow of drilling fluid debris through the hydraulic tool 10 which could very easily foul the hydraulic mechanism. The drop ball 37 must be able to pass freely down through the valve 31 when pumped down the drill string to deactivate the tool 10.

The combination of a drop ball 37 to deactivate a hydraulic tool, a rupture disc 34 to allow fluid circulation while tripping, up-jet nozzles 40 to better clean the hole of debris and a float valve 31 to prevent back flow of debris into a hydraulic tool 10 are contained in one control sub 30. This control sub 30 furnishes the drilling operator a very comprehensive and novel hydraulic control mechanism to be more efficient, less costly and a safer operation of downhole hydraulic tools.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A flow control sub assembly for hydraulically activated tools utilized in downhole operations performed in well boreholes comprising;

a cylindrical sub assembly housing forming a first upstream end and a second downstream end, said housing being threadably connected between a drill string at its first upstream end and a tool at its downstream end, said housing forming a means partially contained within said housing, intermediate said first and second ends, to stop at least a portion of a hydraulic fluid flow to said tool to inactivate said tool and to divert said fluid within said housing to an annulus formed between said housing and a wall of a borehole thereby providing a high volume of fluid around said inactivated tool to continually remove detritus from said downhole operations and to help prevent said tool and said flow control sub assembly from becoming stuck in the borehole as said drill string is removed from said borehole wherein said means to stop said portion of said flow to said tool and to divert said fluid portion to said annulus surrounding said sub assembly is a plug device positioned above said tool and a burst disc positioned in a wall formed by said housing between said plug device and said first end of said sub assembly housing, said plug device, when activated, stops said portion of the fluid flow to said tool and hydraulic fluid under increased pressure from a pump means bursts said disc at a predetermined pressure drop across said disc thereby diverting said fluid to said annulus.

2. The invention as set forth in claim 1 wherein said plug device is a spherical ball, said ball being dropped into a top of said drill string, the ball is subsequently pumped down said drill string until it seats against a reduced diameter section formed by and internally of said sub assembly housing, the opening formed thereby is smaller than a diameter of the ball plug, the ball plug is seated against said reduced section nearest said second end of said housing.

3. The invention as set forth in claim 2 further comprising a one way float valve positioned within said housing between said burst disc and said first end of said sub assembly housing, said float valve automatically closes when said hydraulic fluid pump is stopped thereby preventing debris from backwashing into said tool, said float valve opening is large enough to pass said ball plug therethrough.

4. The invention as set forth in claim 1 further comprising a means to divert a portion of said hydraulic fluid flow pumped down said drill string from a pump means, said portion of fluid is diverted from an interior of said housing to an annulus formed between said housing and said borehole while said tool is activated, said flow diverting means being positioned above said tool, said diverted flow aids in the removal of debris from said borehole during operation of said tool in said well borehole.

5. The invention as set forth in claim 4 wherein said means to divert said flow of fluid within said housing is a nozzle contained within an aperture formed in a wall of said housing, said nozzle directing said portion of fluid to said annulus.

6. The invention as set forth in claim 5 wherein said nozzle is mounted within said aperture at an angle to direct said portion of said fluid toward an entrance of said well borehole.

7. A flow control sub assembly for hydraulically activated remedial tools utilized in downhole operations in well boreholes comprising;

a cylindrical sub assembly housing forming a first upstream end and a second downstream end, said housing being threadably connected between a drill string at its first upstream end and a remedial tool at its downstream end, said housing forming a means partially contained within said housing intermediate said first and second ends, to divert a portion of a hydraulic fluid flow pumped down said drill string by a pump means toward said remedial tool exteriorly of said housing into an annulus formed between said housing and a borehole to aid in the removal of debris from said borehole during operation of said remedial tool in said borehole wherein said means to stop said portion of said flow to said tool and to divert said fluid portion to said annulus surrounding said sub assembly is a plug device positioned above said tool and a burst disc positioned in a wall formed by said housing between said plug device and said first end of said sub assembly housing, said plug device, when activated, stops said portion of the fluid flow to said tool and hydraulic fluid under increased pressure from a pump means bursts said disc at a predetermined pressure drop across said disc thereby diverting said fluid to said annulus.

8. The invention as set forth in claim 7 wherein said means to divert said flow of fluid within said housing is a nozzle positioned above said remedial tool contained within an aperture formed by a wall of said housing, said nozzle serves to direct a portion of said fluid into said annulus.

9. The invention as set forth in claim 8 wherein said nozzle is mounted within said aperture at an angle to direct said portion of said fluid toward an upstream entrance of said well borehole.

* * * * *